US006880911B2

(12) United States Patent
Suzuki et al.

(10) Patent No.: US 6,880,911 B2
(45) Date of Patent: Apr. 19, 2005

(54) INK JET HEAD UNIT

(75) Inventors: Isao Suzuki, Shizuoka (JP); Hideaki Nishida, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 3 days.

(21) Appl. No.: 10/620,908

(22) Filed: Jul. 15, 2003

(65) Prior Publication Data

US 2005/0012773 A1 Jan. 20, 2005

(51) Int. Cl.[7] ..... B41J 29/393
(52) U.S. Cl. ..... 347/20; 347/17
(58) Field of Search ..... 347/17, 20, 44, 347/50, 59

(56) References Cited

U.S. PATENT DOCUMENTS

| | | | | |
|---|---|---|---|---|
| 4,364,059 A | | 12/1982 | Nagayama | |
| 4,504,845 A | | 3/1985 | Kattner et al. | |
| 4,901,091 A | * | 2/1990 | Kasamoto | 347/84 |
| 4,980,702 A | * | 12/1990 | Kneezel et al. | 347/17 |
| 6,802,585 B1 | | 10/2004 | Wratchford | |
| 2003/0052932 A1 | | 3/2003 | Karita et al. | |

FOREIGN PATENT DOCUMENTS

| | | |
|---|---|---|
| EP | 0 928 691 A2 | 7/1999 |
| JP | 3-240553 A | 10/1991 |
| JP | 10-044420 A | 2/1998 |
| WO | WO 01/17779 A2 | 3/2001 |

* cited by examiner

*Primary Examiner*—Lamson Nguyen
*Assistant Examiner*—Blaise Mouttet
(74) *Attorney, Agent, or Firm*—Frishauf, Holtz, Goodman & Chick, P.C.

(57) ABSTRACT

In the ink jet head unit of the present invention, an ink jet head for emitting ink in a formof droplets from nozzles formed in a nozzle face and a driving circuit for driving the ink jet head are mounted on the same surface side of the base board. A groove section is formed in the surface, extending from the nozzle face of the ink jet head to the driving circuit. In the ink jet head, a temperature measuring section is positioned in the groove section. Furthermore, there is provided a sealing member in the groove section, to prevent the flow of ink emitted from the nozzles, into the driving circuit. The sealing member is partly formed of an elastic body. Therefore, since the elastic body can restrain a change in the volume of the sealing member likely to be caused by a temperature change, it is possible to prevent the temperature change from impairing the ink jet head, consequently realizing ink projection stability.

9 Claims, 6 Drawing Sheets

INK JET HEAD UNIT

BACKGROUND OF THE INVENTION

1. Field of the Invention

The present invention relates to an ink jet head unit provided with an ink jet head which projects ink in a form of droplets.

2. Discussion of the Background

As an ink jet head, there is an ink jet head mounted in an ink jet printer, for example. The ink jet head is basically comprised of a pressure chamber which is supplied with ink, a nozzle located in the pressure chamber for emitting the ink, and a driving means for emitting droplets of ink out from the pressure chamber.

The ink jet head mentioned above has been unitized by bonding to a base board the ink jet head together with a driving circuit board having the driving circuit for driving to control the ink jet head. The ink jet head unit thus unitized has a groove section formed in the base board on the same surface side as the ink jet head, and a temperature sensor mounted in the groove section in the ink jet head.

The groove section extends from the nozzle face of the ink jet head to the driving circuit board. On the nozzle face a plurality of nozzles (ink outlets) are formed nearly in a straight line. The temperature sensor functions as a sensor for measuring the temperature of the ink jet head in order to maintain the ink in the ink jet head at a stabilized emission viscosity. The temperature sensor is electrically connected to the driving circuit board. An electric wire for electrical connection of the temperature sensor with the driving circuit board is routed through in the groove section.

In the groove section a sealing member is installed to prevent the flow of ink projected from the nozzle, into the driving circuit board through the groove section. It is therefore possible to prevent a trouble likely to be caused by the ink in the driving circuit on the driving circuit board. As the sealing member, which is demanded to have an ink resistance, an epoxy adhesive is used.

However, when only the epoxy adhesive is used as a sealing member, the volume of the sealing member changes with the expansion and shrinkage of the sealing member resulting from temperature changes. Thus an external force is applied to the ink jet head, which will be subjected to cracking. Therefore there will arise such a problem that the ink jet head will be impaired by a change in the volume of the sealing member caused by temperature changes, resulting in a failure of ink emission in a form of droplets.

SUMMARY OF THE INVENTION

It is, therefore, an object of the present invention to realize stabilized ink emission by preventing temperature changes from giving damage to the ink jet head.

The object of the present invention can be accomplished by the ink jet head unit of the present invention.

A new ink jet head unit of the present invention is comprised of a base board; an ink jet head mounted on the base board to project ink in a form of droplets from a nozzle formed in a nozzle face; a driving circuit for driving the ink jet head, mounted on the base board on the same surface side as the ink jet head; a groove section provided in the base board, on the same surface side as the ink jet head, and extending from the nozzle face of the ink jet head to the driving circuit; a temperature measuring section located in the groove section, in the ink jet head, for measuring the temperature of the ink jet head; and a sealing member provided in the groove section, to thereby prevent the flow of ink emitted from the nozzle, into the driving circuit. The sealing member is partly an elastic member.

Therefore, a new ink jet head unit of the present invention is comprised of a base board; an ink jet head mounted on the base board to project ink in a form of droplets from a nozzle formed in a nozzle face; a driving circuit for driving the inkjet head, mounted on the baseboard on the same surface side as the ink jet head; a groove section provided in the base board, on the same surface side as the ink jet head, and extending from the nozzle face of the ink jet head to the driving circuit; a temperature measuring section located in the groove section, in the ink jet head, for measuring the temperature of the ink jet head; and a sealing member provided in the groove section, to thereby prevent the flow of ink emitted from the nozzle, into the driving circuit. The sealing member is partly a foamed member.

Therefore, a new ink jet head unit of the present invention is comprised of a base board; an ink jet head mounted on the base board to project ink in a form of droplets from a nozzle formed in a nozzle face; a driving circuit for driving the ink jet head, mounted on the base board on the same surface side as the ink jet head; a groove section provided in the base board, on the same surface side as the ink jet head, and extending from the nozzle face of the ink jet head to the driving circuit; a temperature measuring section located in the groove section, in the ink jet head, for measuring the temperature of the ink jet head; and a sealing member provided in the groove section, to thereby prevent the flow of ink emitted from the nozzle, into the driving circuit. The sealing member is partly a closed-cell foamed member.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
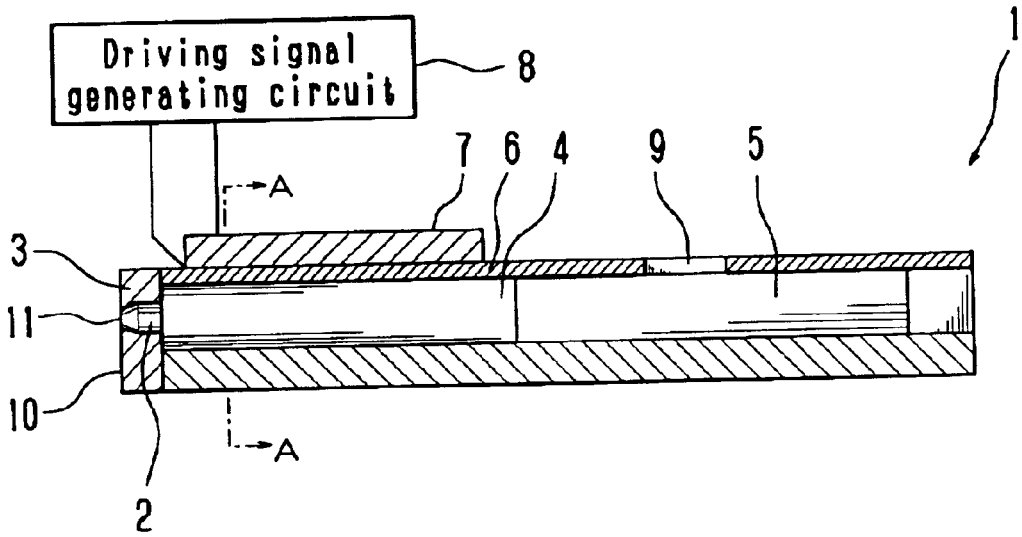
FIG. 1 is a longitudinal side view schematically showing an ink jet head.
Figure 2:
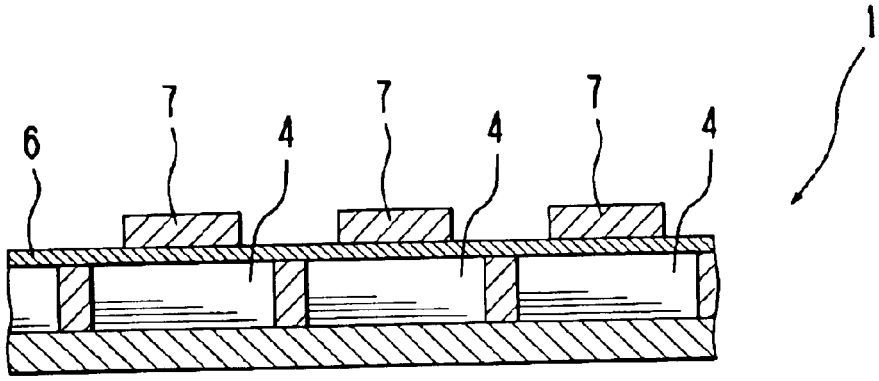
FIG. 2 is a sectional view of the ink jet head taken substantially along line A—A.

One embodiment of an ink jet head unit according to the present invention will be described with reference to the accompanying drawings. FIG. 1 is a schematic longitudinal side view of an ink jet head 1. FIG. 2 is a sectional view thereof taken along line A—A.

The ink jet head 1 has a nozzle plate 3 in which a plurality of nozzles 2 are formed, and a plurality of pressure chambers 4 for holding ink which are located in positions opposite to the plurality of nozzles 2 respectively. The plural pressure chambers 4 are constructed such that the ink is supplied from a common ink chamber 5. A surface forming a part of the pressure chamber 4 is formed of a diaphragm 6. On the diaphragm 6, a plurality of piezoelectric members 7 are secured correspondingly to each of the pressure chambers 4. The diaphragm 6 and the piezoelectric member 7 comprise an actuator; the piezoelectric member 7 being electrically connected to the output terminal of a driving signal generating circuit 8. It should be understood that a piezoelectric element is employed as the piezoelectric member 7, but is not to be limited thereto.

In the common ink chamber 5 an ink supply port 9 connected to an ink tank (not shown) holding the ink through an ink supply line (not shown) is formed. The ink contained in the ink tank, therefore, is supplied to the common ink chamber 5 from the ink supply port 9 through the ink supply line. In a nozzle face 10 of the nozzle plate 3, nozzles (ink outlets) 11 of the plurality of nozzles 2 are formed nearly in a straight line.

For the ink, various kinds of inks such as water-based ink, oil-based ink, solvent ink, and UV ink (ultraviolet-curing ink) are used. The UV ink is made of, for instance, a pigment, a monomer, an oligomer, a photopolymerization initiator, a dispersant, and other additives (e.g., a surface tension adjuster).

In the ink jet head 1 stated above, a driving signal is fed to the piezoelectric member 7 from the driving signal generating circuit 8, to thereby deflect the piezoelectric member 7 to oscillate the diaphragm 6. With the oscillation of the diaphragm 6, the volume of the pressure chamber 4 varies. In the process that the volume of the pressure chamber 4 increases, the ink in the common ink chamber 5 is drawn into the pressure chamber 4. Reversely in the process that the volume of the pressure chamber 4 decreases, the ink in the pressure chamber 4 is emitted as droplets out from the nozzle 2.

In the present embodiment, the piezoelectric member 7 is used as an actuator; however, it will be understood that the present invention is not to be limited thereto. For example, a heating element may be used as the actuator to thereby boil and emit the ink in a form of droplets from the nozzle 2.

Figure 3:
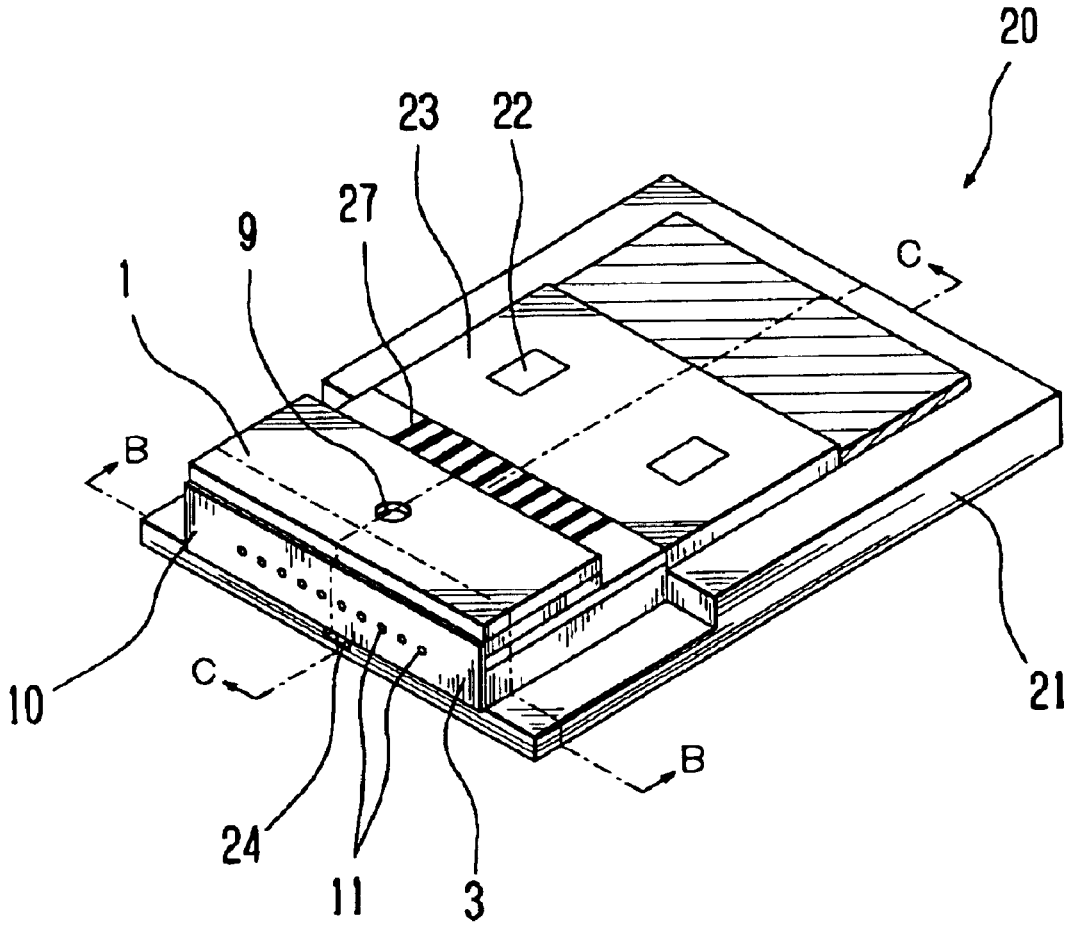
FIG. 3 is an external perspective view schematically showing the ink jet head unit of one embodiment of the present invention.
Figure 4:
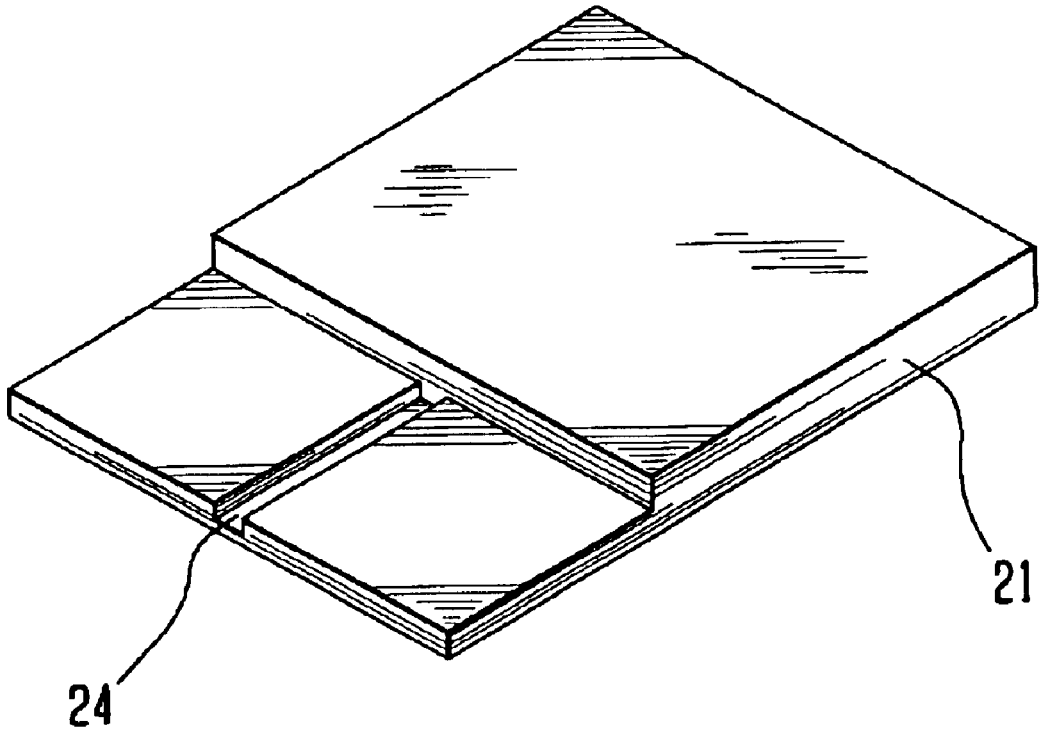
FIG. 4 is an external perspective view schematically showing a base board of the ink jet head unit.
Figure 5:
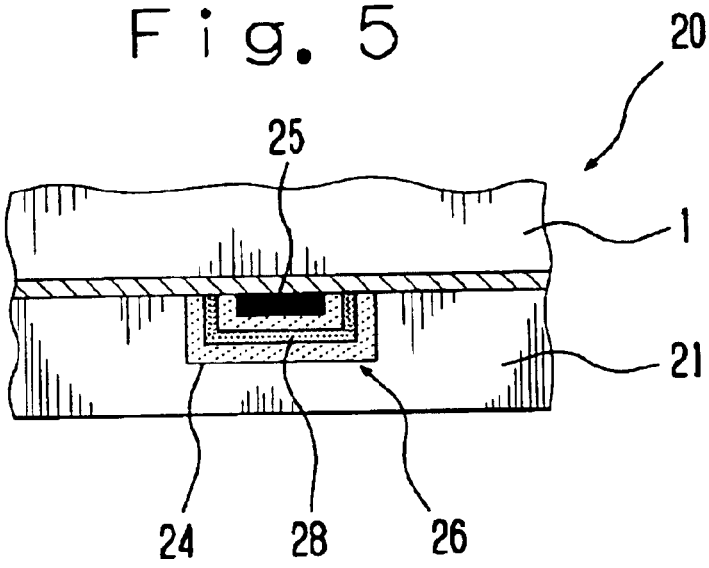
FIG. 5 is an enlarged sectional view schematically showing the ink jet head unit taken substantially along line B—B.

FIG. 3 is an external perspective view schematically showing an ink jet head unit 20. FIG. 4 is an external perspective view schematically showing a base board 21 of the ink jet head unit 20. FIG. 5 is an enlarged sectional view schematically showing the ink jet head unit 20 taken along line B—B. And FIG. 6 is an enlarged sectional view schematically showing the ink jet head unit 20 taken along line C—C.

Figure 6:
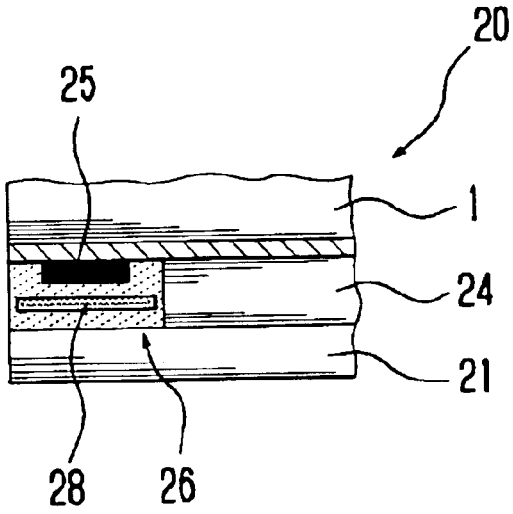
FIG. 6 is an enlarged sectional view schematically showing the ink jet head unit taken substantially along line C—C.

The ink jet head unit 20 is comprised of the base board 21 for holding various kinds of members; the ink jet head 1 mounted on the base board 21 for emitting the ink in a form of droplets from the nozzles 11 formed in the nozzle face 10; a driving circuit board 23 mounted on the base board 21, on the same surface side as the ink jet head, and having a driving IC (integrated circuit) 22 which is a driving circuit for driving the ink jet head 1; a groove section 24 provided on the same surface side as the ink jet head 1 on the base board 21, extending from the nozzle face 10 of the ink jet head 1 to the driving circuit board 23 (see FIG. 4); a temperature sensor 25 mounted on the ink jet head 1, located in the groove section 24, for measuring temperatures of the ink jet head 1 (see FIGS. 5 and 6); and a sealing member 26 located in the groove section 24, for preventing the flow of the ink emitted from the nozzle 11, into the driving circuit board 23 (see FIGS. 5 and 6).

The ink jet head 1 is bonded with an epoxy adhesive on the base board 21, and electrically connected to the driving IC 22 through a wiring pattern 27. The driving IC 22 is provided with the driving signal generating circuit 8. In the present embodiment, the driving IC 22 is mounted on the driving circuit board 23, but is not to be limited thereto. For example, the driving IC 22 may be mounted directly on the base board 21. The base board 21 has a step on the surface (see FIG. 4). The surface in which the groove section 24 is formed and on which the ink jet head 1 is mounted is located in a lower position than the surface on which the driving circuit board 23 is mounted.

The temperature sensor 25 is located in a position opposite to the pressure chamber 4 of the ink jet head 1, in the vicinity of the nozzle face 10 of the ink jet head 1. The temperature sensor 25 is electrically connected to the driving circuit board 23, and an electric wire (not shown) for electrical connection between the temperature sensor 25 and the driving circuit board 23 is routed, passing through the groove section 24. The temperature sensor 25 has a resistance to ink, but is not to be limited thereto. The groove section 24 is formed straight from the nozzle face 10 side to the driving circuit board 23 side, but is not to be limited thereto.

The sealing member 26 is formed of for instance an epoxy resin which is an ink-resisting resin, and partly of an elastic body 28. That is, the sealing member 26 is constructed of the epoxy resin including the elastic body 28. As shown in FIGS. 5 and 6, the elastic body 28 is mounted so as to cover the temperature sensor 25 and not to appear out of the sealing member 26.

For the elastic body 28, various kinds of rubber materials such as silicone rubber are used. In the present embodiment, the elastic body 28 having ink resistance is adopted, but is not to be limited thereto. For example, a rubber material having no ink resistance will become usable as the elastic body 28 by adopting the construction that the elastic body 28 is covered with an ink-resisting epoxy resin. Here, the sealing member 26 is installed in the groove section 24 when the ink jet head 1 and the base board 21 are bonded.

In the present embodiment described above, the sealing member 26 is partly formed of the elastic body 28, thus enabling the elastic body 28 to restrain (alleviate) a change in the volume of the sealing member 26 even when the volume of the sealing member 26 is changed with a temperature change and accordingly preventing giving damage to the ink jet head 1 in case of the temperature change to thereby realize stabilized ink emission.

Figure 7:
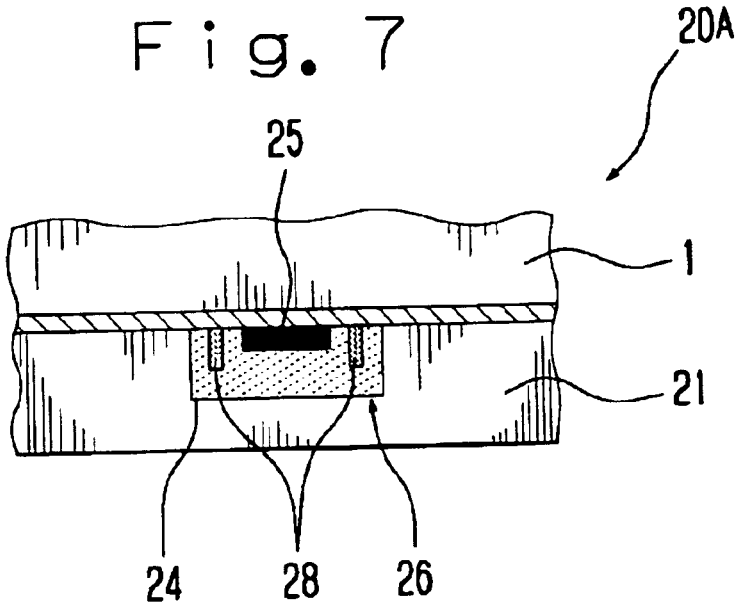
FIG. 7 is an enlarged sectional view schematically showing an ink jet head unit of a modification 1 of the one embodiment of the present invention taken substantially along line B—B.
Figure 8:
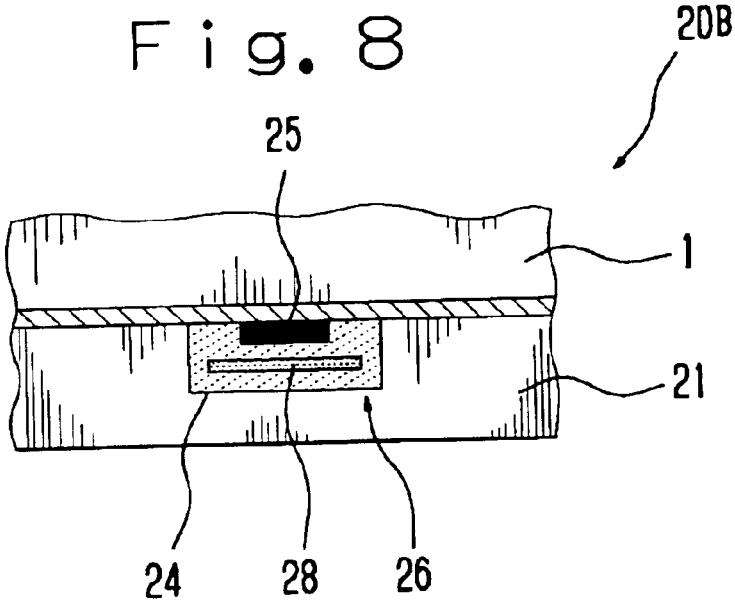
FIG. 8 is an enlarged sectional view schematically showing an ink jet head unit of a modification 2 of one embodiment of the present invention taken substantially along line B—B.

In the present embodiment, as shown in FIG. 5, the elastic body 28 is mounted so as to cover the temperature sensor 25, but is not to be limited thereto. FIG. 7 is an enlarged sectional view schematically showing an ink jet head unit 20A of a modification 1 according to one embodiment of the present invention taken along line B—B. FIG. 8 is also an enlarged sectional view schematically showing an ink jet head unit 20B of a modification 2 according to one embodiment of the present invention taken along line B—B. For instance, as shown in FIG. 7, the elastic body 28 may be located on either side of the temperature sensor 25 in such a manner that the height of the elastic body 28 above the surface of the ink jet head 1 will be higher than the surface of the temperature sensor 25. Also as shown in FIG. 8 the elastic body 28 may be positioned between the temperature sensor 25 and the base board 21.

Figure 9:
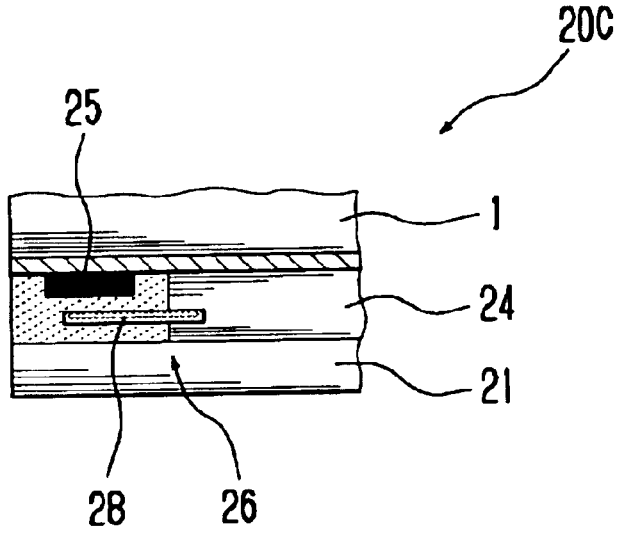
FIG. 9 is an enlarged sectional view schematically showing an ink jet head unit of a modification 3 according to one embodiment of the present invention.

Furthermore, in the present embodiment, the elastic body 28 is mounted so as not to appear out of the sealing member 26 as shown in FIG. 6, but is not to be limited thereto. FIG. 9 is an enlarged sectional view schematically showing an ink jet head unit 20C of a modification 3 according to one embodiment of the present invention taken along line C—C. For instance, as shown in FIG. 9, the elastic body 28 may be mounted in such a manner that a part thereof will appear out of the sealing member 26. Thus the elastic body 28 appearing from the sealing member 26 can partly easily deflect without interference by the sealing member 26. Furthermore, because of a large amount of deflection of the elastic body 28, a change in the volume of the sealing member 26 can be restrained.

Furthermore, the elastic body 28, having an ink resistance, can appear out from both ends of the sealing member 26. Consequently, the elastic body 28 can largely deflect as compared with the case of the elastic body 28 which appears only from one end of the sealing member 26, thereby fully restraining a change in the volume of the sealing member 26.

When the elastic body 28 has no ink resistance, a part of the elastic body 28 appearing from the sealing member 26 is located on the opposite side where the sealing member 26 comes into contact with the ink. It is therefore possible to expose one part of the elastic body 28 even when the elastic body 28 has no ink resistance.

Figure 10:
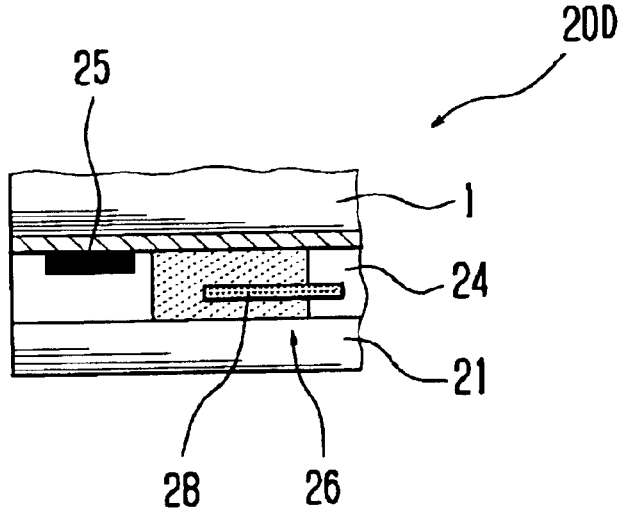
FIG. 10 is an enlarged sectional view schematically showing an ink jet head unit of a modification 4 according to one embodiment of the present invention taken substantially along line C—C.

Furthermore, in the present embodiment, the temperature sensor 25 is mounted in such a position where it will not appear out of the sealing member 26, but is not to be limited thereto as shown in FIG. 6. FIG. 10 is a schematic sectional view of an ink jet head unit 20D of a modification 4 according to one embodiment of the present invention taken along line C—C. For instance, the sealing member 26 may be mounted in such a manner that the whole part of the temperature sensor 25 will appear from the sealing member 26 as shown in FIG. 10. Furthermore, the sealing member 26 may be mounted in such a manner that the temperature sensor 25 will partly appear from the sealing member 26.

Furthermore, in the present embodiment, the elastic body 28 is used in a part of the sealing member 26, but is not to be limited thereto. For instance, a foamed body may be used in place of the elastic body 28. As the foamed body, a foamed polyurethane type or a closed-cell foamed body, for example, is used. As the closed-cell foamed body, fluororubber sponge is used.

Furthermore, when the closed-cell foamed body having an ink resistance is used, the closed-cell foamed body can appear from both ends of the sealing member 26. Consequently, since the foamed body largely deflects as compared with the case of the foamed body appearing only from one end of the sealing member 26, a change in the volume of the sealing member 26 can be substantially restrained.

Furthermore, in the present embodiment, the sealing member 26 is formed of epoxy resin and the elastic body 28, but is not to be limited thereto. For instance, the whole part of the sealing member 26 may be formed of the closed-cell foamed body. The adoption of the whole body of the sealing member 26 thus formed of the closed-cell foamed body can restrain (alleviate) the change in the volume of the sealing member 26 even in case of a change in the volume of the sealing member 26 caused by temperature changes. It is, therefore, possible to prevent temperature changes from impairing the ink jet head 1, thereby realizing stabilized ink projection.

Obviously, numerous modifications and variations of the present invention are possible in light of the above teachings. It is therefore to be understood that within the scope of the appended claims, the invention may be practiced otherwise than as specifically described herein.

What is claimed is:

1. An ink jet head unit, comprising:

a base board;

an ink jet head mounted on the base board, for emitting ink in a form of droplets from nozzles formed in a nozzle face;

a driving circuit for driving the ink jet head, mounted on the base board, on the same surface side as the ink jet head;

a groove section provided in the base board, on the same surface side as the ink jet head, and extending from the nozzle face of the ink jet head to the driving circuit;

a temperature measuring section mounted on the ink jet head, positioned in the groove section, for measuring temperatures of the ink jet head; and a sealing member installed in the groove section to prevent ink emitted from the nozzles, from flowing into the driving circuit, wherein the sealing member is partly an elastic body.

2. An ink jet head unit according to claim 1, wherein the elastic body partly appears from the sealing member.

3. An ink jet head unit according to claim 2, wherein the elastic body appearing from the sealing member is partly positioned oppositely to the side where the sealing member comes into contact with ink.

4. An ink jet head unit according to claim 2, wherein the elastic body has a resistance to ink.

5. An ink jet head unit, comprising:

a base board;

an ink jet head mounted on the base board, for emitting ink in a form of droplets from nozzles formed in a nozzle face;

a driving circuit for driving the ink jet head, mounted on the base board, on the same surface side as the ink jet head;

a groove section provided in the base board, on the same surface side as the ink jet head, and extending from the nozzle face of the ink jet head to the driving circuit;

a temperature measuring section mounted on the ink jet head, positioned in the groove section, for measuring temperatures of the ink jet head; and a sealing member installed in the groove section to prevent ink emitted from the nozzles, from flowing into the driving circuit, wherein the sealing member is partly a foamed body.

6. An ink jet head unit according to claim 5, wherein the foamed body appears partly from the sealing member.

7. An ink jet head unit according to claim 6, wherein the foamed body appearing from the sealing member is partly positioned oppositely to the side where the sealing member comes into contact with ink.

8. An ink jet head unit according to claim 6, wherein the foamed body has a resistance to ink, and is a closed-cell foamed body.

9. An ink jet head unit, comprising:

a base board;

an ink jet head mounted on the base board, for emitting ink in a form of droplets from nozzles formed in a nozzle face;

a driving circuit for driving the ink jet head, mounted on the base board, on the same surface side as the ink jet head;

a groove section provided in the base board, on the same surface side as the ink jet head, and extending from the nozzle face of the ink jet head to the driving circuit;

a temperature measuring section mounted on the ink jet head, positioned in the groove section, for measuring temperatures of the ink jet head; and a sealing member installed in the groove section to prevent ink emitted from the nozzles, from flowing into the driving circuit, wherein the sealing member is a closed-cell foamed body.

* * * * *